US005584093A

United States Patent [19]

Melendres

[11] Patent Number: 5,584,093

[45] Date of Patent: Dec. 17, 1996

[54] DUCT CLEANING APPARATUS

[75] Inventor: Joseph V. Melendres, Fort Worth, Tex.

[73] Assignee: Clean-Aire International, Inc., Fort Worth, Tex.

[21] Appl. No.: 327,020

[22] Filed: Oct. 21, 1994

[51] Int. Cl.[6] ..... B08B 9/04; A47L 7/00

[52] U.S. Cl. ..... 15/304; 15/339; 15/395; 134/113

[58] Field of Search ..... 15/304, 339, 395; 134/113

[56] References Cited

U.S. PATENT DOCUMENTS

| | | | |
|---|---|---|---|
| 2,193,999 | 3/1940 | Allen | 15/304 |
| 3,775,805 | 12/1973 | Mitchell | 15/304 |
| 3,800,358 | 4/1974 | Ryan . | |
| 4,006,359 | 2/1977 | Sullins et al. . | |
| 4,473,921 | 10/1984 | Weber | 15/304 |
| 4,607,925 | 8/1986 | Kamigaichi et al. . | |
| 4,654,702 | 3/1987 | Tolino et al. . | |
| 4,661,848 | 4/1987 | Matsuda . | |
| 4,792,363 | 12/1988 | Franklin et al. . | |
| 4,800,616 | 1/1989 | Wade . | |
| 4,976,002 | 12/1990 | Leonov | 15/395 |
| 4,984,329 | 1/1991 | Wade . | |
| 5,020,188 | 6/1991 | Walton | 15/304 |
| 5,107,568 | 4/1992 | Wade . | |
| 5,109,567 | 5/1992 | Harrison . | |
| 5,195,209 | 3/1993 | Watkins | 15/339 |
| 5,311,641 | 5/1994 | Matsuura et al. . | |
| 5,428,862 | 7/1995 | Sailer | 15/304 |

FOREIGN PATENT DOCUMENTS

| | | | |
|---|---|---|---|
| 9350 | 5/1899 | United Kingdom | 15/395 |
| 0002565 | 6/1985 | WIPO | 15/304 |

*Primary Examiner*—David Scherbel
*Assistant Examiner*—Randall E. Chin
*Attorney, Agent, or Firm*—Ross, Clapp, Korn & Montgomery, L.L.P.

[57] ABSTRACT

An apparatus for cleaning the interior surfaces of an air duct includes a housing. A conduit having an intake opening at one end thereof and an exhaust opening at the opposite end thereof is coupled to the housing. Brushes are mounted to the housing for sweeping engagement with the interior surfaces of the air duct. A vacuum supply is provided to the conduit, such that dust and foreign matter which is loosened by the brushes is drawn into the conduit at the intake opening for transport to the exhaust opening. A video camera is mounted within the housing and spaced forward of the brushes for generating an image of the interior of the air duct. A display displays the image generated by the video camera during an air duct cleaning operation.

5 Claims, 2 Drawing Sheets

DUCT CLEANING APPARATUS

TECHNICAL FIELD OF THE INVENTION

The present invention relates to an air duct cleaning apparatus, and more particularly to an apparatus utilizing a video camera for viewing cleaning operations.

BACKGROUND OF THE INVENTION

Difficulty has been encountered in connection with the commercial cleaning of air ducts, such as, for example, hot air furnace ducts, air conditioning ducts, ventilating ducts, and the like, such as are commonly employed in office buildings, factories, foundries, and other commercial establishments as well as residential dwellings. Various methods are currently in use in connection with cleaning and conditioning such ducts, depending upon the size, cross-sectional shape and the linear paths along which such ducts extend.

Apart from strictly manual duct-cleaning operations, certain semi-automatic cleaning procedures have been developed. These procedures usually involve the manual feeding of a long flexible suction tube through the duct from different access openings. This procedure may be preceded by a dust loosening operation, utilizing long-handled brush arrangements which must be manipulated in order to ensure loosening of dust from the side, overhead, and floor surfaces of the duct.

Procedures may utilize rotary brushes which sweep circumferentially about the inner cylindrical walls of a conduit, and, together with suction heads withdraw the loosened dust and other foreign matter. Devices may be self-propelled through the conduit or pipe, or manually guided therethrough.

Although various duct cleaning procedures and apparatus exists, the quality of the cleaning operation is incapable of being determined in real time during the cleaning operation, as inspection of the duct is not possible. Visual inspection may be accomplished after the cleaning apparatus has been removed from a duct; however, such procedures require duplicative cleaning efforts, resulting in additional time required to clean ducts.

A need has thus arisen for a duct cleaning apparatus which provides the capability of making visual inspections during a cleaning operation to ensure proper and efficient cleaning of air ducts.

SUMMARY OF THE INVENTION

In accordance with the present invention, an apparatus for cleaning the interior surfaces of an air duct is provided. The apparatus includes a housing. A conduit having an intake opening at one end thereof and an exhaust opening at the opposite end thereof is provided. The intake opening is coupled to the housing. Brushes are mounted to the housing for sweeping engagement with the interior surfaces of the air duct. A vacuum supply is provided to the conduit, such that dust and foreign matter which is loosened by the brushes is drawn into the conduit at the intake opening for transport to the exhaust opening. A video camera is mounted within the housing and spaced forward of the brushes for generating an image of the interior of the air duct. A display is provided for displaying the image generated by the video camera during an air duct cleaning operation.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
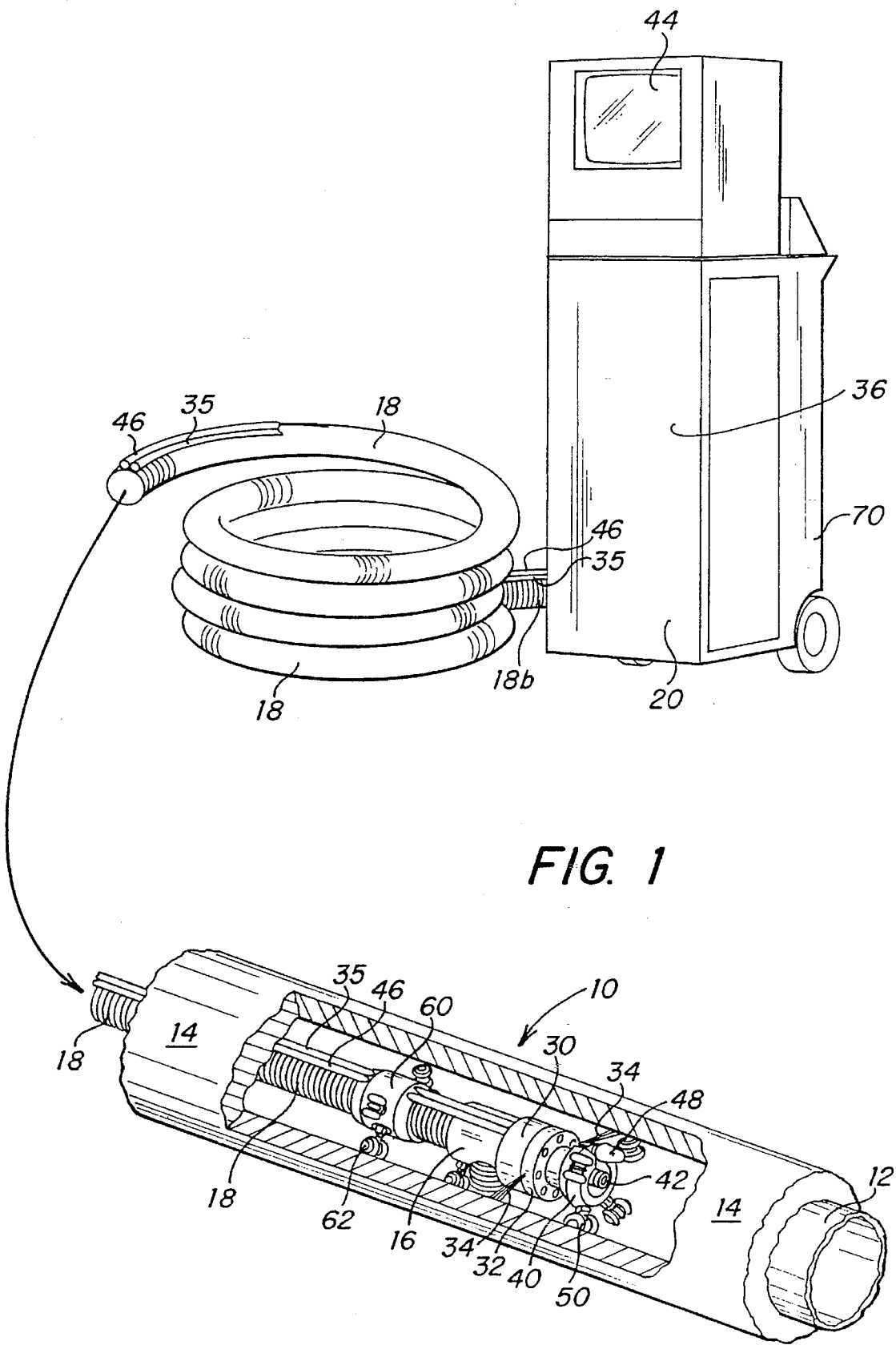
FIG. 1 is a perspective view of the present apparatus illustrating the cleaning head disposed within an air duct.
Figure 2:
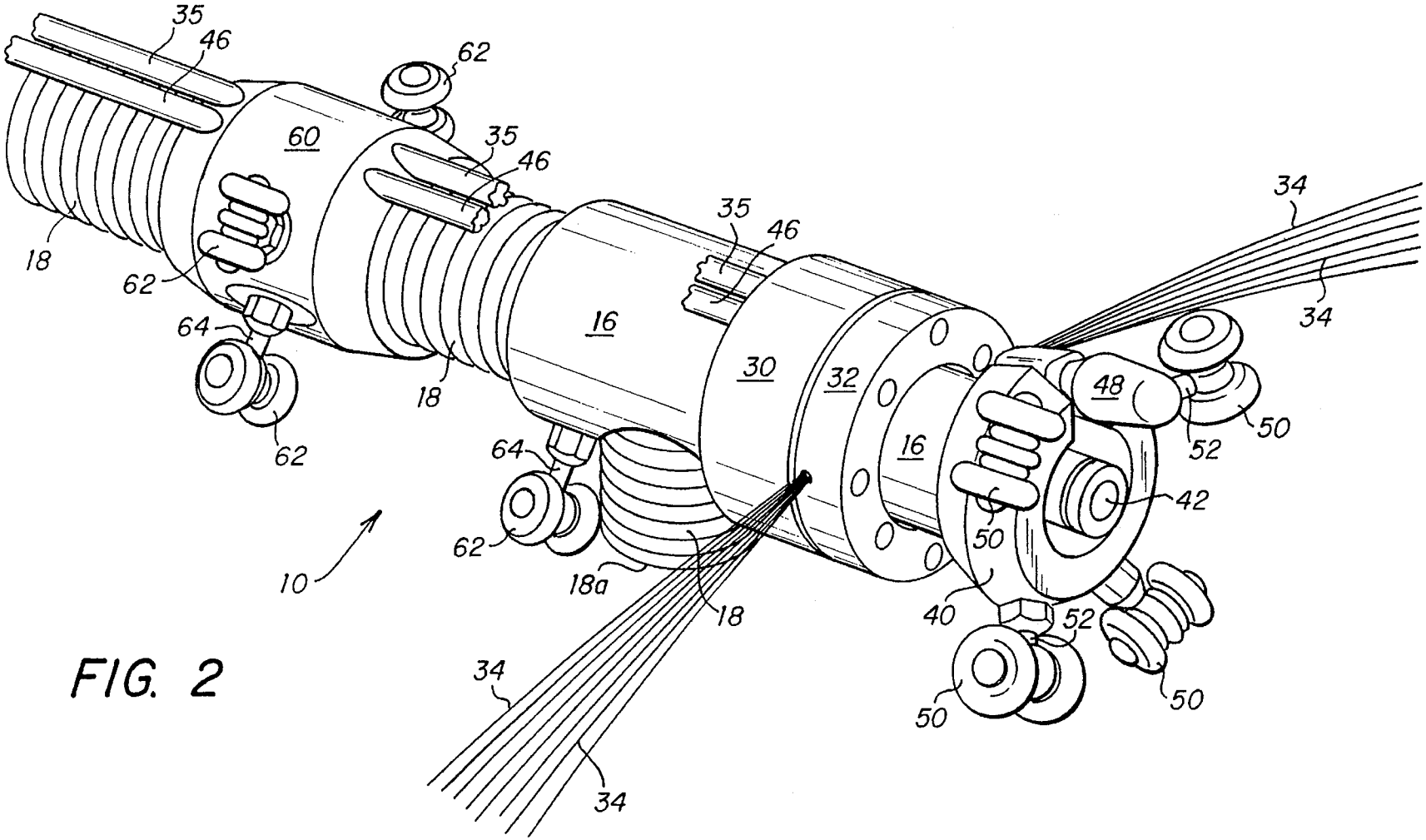
FIG. 2 is an enlarged perspective view of the present cleaning head and portion of the vacuum conduit.

Referring simultaneously to FIGS. 1 and 2, the present air duct cleaning apparatus is illustrated, and is generally identified by the numeral 10. Apparatus 10 is utilized for cleaning ducts, such as for example, a duct 12 illustrated in FIG. 1. As used herein, the term "duct" includes all types of ventilating system conduits, including vents and ducts. Duct 12 is shown encircled with insulating material 14.

Apparatus 10 includes a head, generally identified by the numeral 16. Interconnected to head 16 is a conduit 18 having an intake opening 18*a* and an exhaust opening 18*b*. Dust and other foreign matter contained within duct 12 is removed via conduit 18 by the application of suction applied by a vacuum source 20. Disposed within vacuum source 20 is a container (not shown) for the deposit of dust and particles removed from duct 12.

Mounted forward of head 16 is a rotor 30 which is interconnected to a hub 32. Interconnected to hub 32 are a plurality of brushes 34. Brushes 34 are caused to rotate through operation of rotor 30 in order to sweepingly engage the interior surfaces of air duct 12 thereby removing dust and foreign material from the interior surfaces of duct 12. Rotor 30 is caused to rotate by air pressure supplied to rotor 30 via a pipe 35. Air pressure may be generated from a source 36. Pipe 35 extends along the entire length of conduit 18 to source 36.

Attached to head 16 is a housing 40. Mounted within housing 40 is a video camera 42 which provides electronic signals necessary to create a video image of the interior surfaces of duct 12. The image generated by camera 42 is displayed on a video camera monitor 44 (FIG. 1). Monitor 44 provides a real time display of the interior of duct 12 during a cleaning operation. A camera cable 46 interconnects camera 42 with monitor 44. Camera 42 may comprise, for example, a microvideo camera manufactured and sold by Panasonic, Model No. GP-KS102.

Housing 40 also includes an illumination source 48 for providing illumination for camera 42. Also disposed circumferentially around housing 40 are a plurality of height adjustment wheels 50. Height adjustment wheels 50 are mounted to housing 40 via a threaded shaft 52. Wheels 50 provide height adjustment and centering for housing 40 within duct 12 in order to center camera 42 within duct 12 during the cleaning operation. Wheels 50 are threaded along shafts 52 depending upon the distance, wheels 50 will extend outwardly from housing 40. Wheels 50 will engage the interior of duct 12 at several locations in order to maintain housing 40 centered within duct 12.

Located along conduit 18 and periodically spaced apart is a conduit ring 60, only one such ring 60 being illustrated in the Figures. Conduit ring 60 supports pipe 35 and cable 46 along circuit 18. Cirumferentially disposed around ring 60 are a plurality of adjustable wheels 62. Wheels 62 are supported on threaded shafts 64. Wheels 62 assist conduit 18 when moving through duct 12 during cleaning operations. Wheels 62 are adjusted along threaded shafts 64 depending upon the diameter of duct 12.

Through operation of the present apparatus, real time viewing of the interior of duct 12 can be accomplished using camera 42 and monitor 44. Monitor 44 is disposed at a location remote from duct 12 to allow for easily viewing of monitor 44 in order to monitor the cleaning operation in real time. As head 16 is removed from duct 12, the effectiveness of the cleaning operation can be viewed via camera 42 and monitor 44. Camera 42 is mounted forward of brushes 34 so that dust and debris do not interfere with the operation of camera 42 as such dust and debris is removed from the interior surfaces of duct 12. Video camera 44, vacuum source 20 and air source 36 may be mounted to a cart 70 for ease in maneuvering these components of the present apparatus 10.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. An apparatus for cleaning the interior surfaces of an air duct, the air duct having a length, the apparatus comprising:

a housing having an aperture and a centrally disposed axis in a direction along the length of the air duct;

a conduit having an intake opening at one end thereof, and an exhaust opening end at the opposite end thereof, said intake opening coupled to said housing;

brushes mounted adjacent to and rearward of said housing for sweeping engagement with the interior surfaces of the air duct, said brushes being mounted for rotation around said housing axis;

means for supplying vacuum to said conduit, such that dust or foreign matter which is loosened by said brushes is drawn into said conduit at said intake opening for transport to said exhaust opening;

a video camera disposed within said housing aperture and along said axis and spaced forward of said brushes for generating an image of the interior of the air duct along the length of the air duct; and means connected to said video camera for displaying said image generated by said video camera during an air duct cleaning operation, said display means being located remote from said housing.

2. The apparatus of claim 1 and further including:

means attached to said housing for centrally locating said housing in the air duct.

3. The apparatus of claim 1 and further including a ring mounted circumferentially around said conduit; and a plurality of wheels mounted circumferentially around said ring.

4. The apparatus of claim 1 and further including:

means attached to said conduit for enabling said conduit to move through the air duct.

5. The apparatus of claim 4 wherein said enabling means includes a ring circumferentially disposed around said conduit; and a plurality of wheels radially disposed around said ring and projecting outwardly of said ring.

* * * * *